United States Patent [19]

Davi et al.

[11] 4,409,787

[45] Oct. 18, 1983

[54] ACOUSTICALLY TUNED COMBUSTOR

[75] Inventors: Michael A. Davi; Lewis B. Davis, Jr., both of Schenectady; Edward P. Hopkins, East Berne, all of N.Y.

[73] Assignee: General Electric Company, Schenectady, N.Y.

[21] Appl. No.: 34,341

[22] Filed: Apr. 30, 1979

[51] Int. Cl.[3] ..... F02G 1/00

[52] U.S. Cl. ..... 60/39.77; 60/725

[58] Field of Search ..... 60/39.77, 39.01, 725; 181/206, 207, 211

[56] References Cited

U.S. PATENT DOCUMENTS

| | | | |
|---|---|---|---|
| 2,523,379 | 9/1950 | Kollsman | 60/39.77 X |
| 2,543,758 | 3/1951 | Bodine, Jr. | 60/39.77 X |
| 2,796,734 | 6/1957 | Bodine, Jr. | 60/39.77 |
| 3,166,904 | 1/1965 | Melenric | 60/39.77 X |
| 3,486,331 | 12/1969 | Brown | 60/39.77 |
| 4,122,674 | 10/1978 | Andersson et al. | 60/725 |

*Primary Examiner*—Jerry W. Myracle

*Attorney, Agent, or Firm*—J. C. Squillaro

[57] ABSTRACT

A stationary gas turbine combustor having a fuel nozzle and a combustion chamber receiving the fuel nozzle also contains a pressure wave interference element fixed within the interior of the combustor and disposed in the path of the variable pressure waves to modify the intensity of the pressure waves and the location of their nodes.

5 Claims, 4 Drawing Figures

FIG. 1.
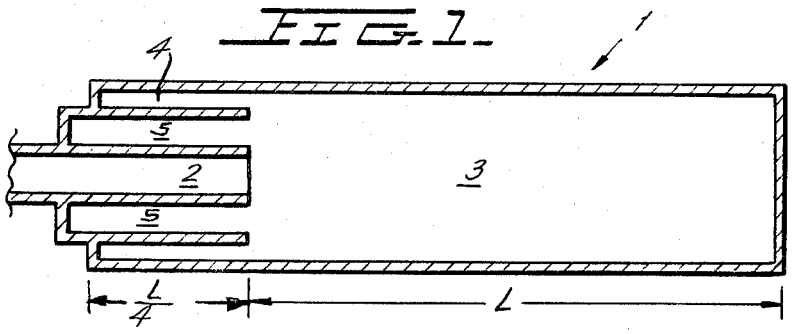
FIG. 2.
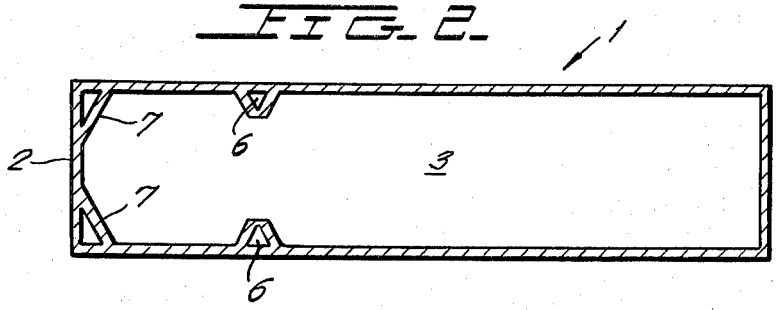
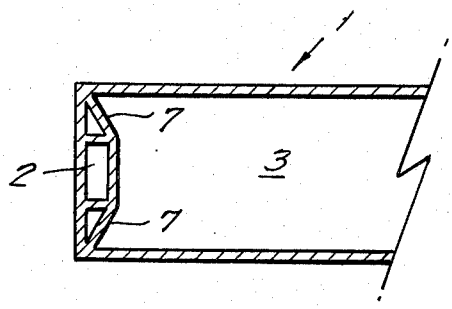
FIG. 3.
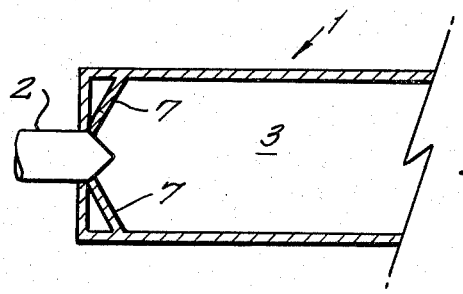
FIG. 4.

ACOUSTICALLY TUNED COMBUSTOR

BACKGROUND OF THE INVENTION

All combustion systems, including stationary gas turbine combustors, can operate in a mode where high pressure oscillations exist in the vicinity of and are sustained by the flame. These oscillations are driven either by a periodic fluctuation in the fuel or air flow caused by an external source or by a coupling of the heat release rate and an acoustical mode of the combustion chamber. In either case, the resulting pressure oscillations generate mechanical stresses in the combustion hardware and can also generate very high levels of noise. The magnitude of the stresses in the hardware varies considerably depending upon the degree of coupling between the acoustical mode and the heat release rate, and failures can occur in a time period as brief as a few minutes. Further, the weak coupling significantly limits the life of the apparatus parts as compared to their design values and therefore results in added expense for inspections and repair or replacement.

Much of the effort devoted to reducing dynamic pressure oscillations in combustion systems have been directed toward the highly destructive pure tone resonances found in all types of combustors. There is, however, a much lower level narrow band pressure oscillation, caused by the same factors leading to the pure tone resonance, that significantly limits combustion hardware operating life.

Driven oscillations, i.e. those caused by external sources such as the fuel supply or the air supply, can generally be controlled by careful attention to design of the combustion system. The control of acoustical oscillations, however, can be more difficult particularly when the fundamental frequency of the combustor is less than 300–500 hz. In these cases, a weak coupling between the acoustic mode and the heat release rate usually occurs although there will be some operating conditions where a strong coupling (pure tone combustion resonance) exits.

Prior efforts for controlling dynamic pressures in combustion systems have been mainly concerned with rocket engines where the general approach has been to utilize known design methods to securely anchor the flame front downstream of a flameholder or to otherwise change the local fuel-air ratio in the flame zone and thus destroy the phase relationship between the pressure and heat release pulsations. Most of such methods are ineffective in those cases where there is only a weak coupling between the pressure and heat release.

Accordingly, it is the object of this invention to provide a combustor in which the narrow band dynamic pressure oscillations are reduced thereby extending equipment life and reducing noise. This and other objects of the invention will become apparent to those skilled in the art from the following detailed description in which FIGS. 1-4 are schematic cross-sections of four different embodiments of the invention.

SUMMARY OF THE INVENTION

This invention relates to an acoustically tuned combustor and a method of acoustically tuning a combustor. More particularly, the invention relates to a stationary gas turbine combustor which has a pressure wave interference means fixed within the interior of the combustor and disposed in the path of the variable pressure waves to modify the intensity of the waves at the location of their nodes. As a result of the invention, at least a partial uncoupling of the heat release rate from the acoustic modes of the combustor is achieved so that the combustor is capable of operating over the entire gas turbine start-up and load cycle with significantly reduced pressure oscillations.

BRIEF DESCRIPTION OF THE DRAWINGS

FIG. 1 shows an anechoic combustor having quarter wave length pressure wave interference means.

FIG. 2 shows a combustor having one or more acoustical baffles.

FIG. 3 shows a combustor in which means isolate the base of the flame from acoustical pressure waves.

FIG. 4 shows an embodiment similar to FIG. 3 but having a different wall configuration.

DESCRIPTION OF THE INVENTION

Four embodiments of the present invention are illustrated in FIGS. 1 to 4. Each figure schematically shows a stationary gas turbine combustor 1 which contains a fuel nozzle 2 for producing a flame which produces variable pressure waves which propagate from the flame. Fuel nozzle 2 can be of conventional construction, as described hereinafter, or as shown in copending application Ser. No. 018,932, filed Mar. 9, 1979 and assigned to the assignee of this invention. Each combustor 1 also includes a combustion chamber 3 which receives fuel nozzle 2 at one end thereof and extends axially away from said fuel nozzle 2. Each of the combustors also contains a pressure wave interference means fixed within the interior of the combustor and disposed in the path of said variable pressure waves to modify the intensity of said pressure waves at the location of their nodes. Thus, the effect of the present invention in each case is to at least partially isolate the heat release zone from the pressure anti-node that exists at the upstream end of the combustor.

The embodiments shown in FIGS. 1 and 2 accomplish the object of the invention by eliminating the pressure anti-node in the flame zone. The embodiments shown in FIGS. 3 and 4 accomplish the object by uncoupling the heat release rate from the acoustic pressure waves by preventing them from being concentrated at the base of the flame.

The embodiment shown in FIG. 1, called an anechoic combustor, employs the pressure wave interference means in the form of a quarter wave length reflection chamber or tube 4 which extends from said one end in a direction substantially opposite to the direction of said combustion chamber 3. The anechoic combustor functions in the following manner. A pressure pulse is generated in the flame zone adjacent fuel nozzle 2 at a time $t=0$. The pressure pulse is propagated at the speed of sound (c) both downstream (to the right in FIG. 1) and upstream (to the left in FIG. 1). In a gas turbine combustor, the pressure wave traverses the distance (L) from the flame zone to the downstream end of the combustor in a time $t+L/c$ and is partially reflected at the downstream end so that the return pressure pulse to the flame zone arrives at a time $2L/c$. At the same time, the pulse of pressure propagated upstream has broken into two parts. The part which entered the quarter wave length chamber 4 is reflected and returns to the flame zone at time $L/2c$ when the pressure at that point is at a minimum. Similarly, at time $2L/c$ the quarter wave length chamber 4 returns a pressure minimum while the reflective pressure maximum is returning from the downstream end of combustor 1.

In any combustion system, variations in the heat release rate are strongly affected by the volume of the burning zone, by the turbulence level in the fluid flow and by axial temperature gradients. It is therefore advantageous to additionally utilize a secondary chamber 5 of the same length as chamber 4 or a length defined by a dominant frequency. Secondary chamber 5 is constructed and disposed in the same manner as quarter wave length tube or chamber 4 except that its length is permanently fixed by the characteristics of the flame zone and fuel nozzle 2.

The pressure wave interference means utilized by the embodiment shown in FIG. 2 is one or more acoustical baffles 6 which is fixed within combustion chamber 3 downstream of the flame front. Baffle 6 can be of any desired configuration and the embodiment shown in FIG. 2 is a ring of truncated conical cross-section. A pressure pulse generated at fuel nozzle 2 propagates downstream (to the right in FIG. 2) and encounters acoustical baffle 6 at a time $t_1$. A portion of the energy in the pulse passes through the baffle while the remainder is reflected back upstream toward the flame zone and fuel nozzle 2. The reflected part returns to the flame zone at time $2t_1$ and the flame is thus exposed to an exitation whose frequency ($\frac{1}{2}t_1$) depends on the location of the baffle. Accordingly, baffle 6 is located at a position so that the frequency is maintained at a high value since typical diffusion flames in gas turbine combustors do not strongly respond to exitations whose frequencies are much above 500 hz.

The energy which is transmitted through baffle 6 serves to set up a standing wave, just as in a conventional combustion system, because baffle 6 consitutes a partially closed end. It will be appreciated, however, that the energy feeding the standing wave is significantly less than in the conventional combustor and the frequency is higher because the baffle 6 effectively shortens the length of combustor 3.

The embodiments shown in FIGS. 3 and 4 isolate the base of the flame from acoustical pressure waves by shaping the combustor and/or the fuel nozzle so that locally impinging waves are reflected away from the base of the flame rather than onto it. In FIG. 3, it will be noted that the angle between combustor cap 7 and said one end has been reversed from the conventional configuration shown in FIGS. 2 and 4. In the embodiment of FIG. 4, that portion of fuel nozzle 2 extending into combustion chamber 3 is conically shaped so that the flame waves are dispersed.

The utility of the embodiments shown in FIGS. 3 and 4 are more restricted than those of FIGS. 1 and 2. The FIGS. 3 and 4 embodiments are particularly adapted to uncouple the flame from acoustical pressure oscillations in particular circumstances such as when water is injected into the flame zone to control nitrogen oxide emissions.

An anechoic combustor was constructed as shown in FIG. 1 with secondary quarter length chamber 5 having a length of L/8. The combustor was operated at conditions corresponding to various gas turbine loads and the results compared to the results realized using a conventional commercial gas turbine combustor. These results are shown in Table 1.

TABLE 1

| Load Range | Dynamic Pressure Level (RMS, psi) Conventional System | Anechoic Combustor |
|---|---|---|
| Low | 1.22 | 0.73 |
| Mid | 1.30 | 0.86 |
| High | 1.20 | 0.90 |

A combustor was constructed in accordance with FIG. 3 and the dynamic pressure level at high load with the injection of water determined and compared to a conventionally available combustor. The results are shown in Table 2.

TABLE 2

| Water Injection Rate Percentage Combustion Inlet Air Flow | Dynamic Pressure Level (RMS, psi) Conventional System | Modified Cap |
|---|---|---|
| 0 | 1.20 | 0.87 |
| 1.55 | 2.20 | 1.16 |
| 2.0 | 2.17 | 1.27 |

Various changes can be made in the process and products of this invention without departing from the spirit and scope thereof. For example, the various embodiments shown in FIGS. 1–4 can be appropriately combined if desired. It will therefore be appreciated that the various embodiments disclosed herein were for the purpose of further illustrating the invention but were not intended to limit it.

What is claimed is:

1. A stationary gas turbine combustor comprising, in combination;

a fuel nozzle for producing a flame which produces variable pressure waves which propagate from said flame;

a combustion chamber receiving said fuel nozzle at one end thereof and extending axially away from said fuel nozzle; and pressure wave interference means fixed within the interior of said combustor and disposed in the path of said variable pressure waves to modify the intensity of said pressure waves and the location of their nodes, said pressure wave interference means comprising a quarter wave length reflection chamber at said one end extending substantially axially away from said combustion chamber.

2. The stationary gas turbine combustor of claim 1 additionally comprising a secondary quarter wave length reflection chamber at said one end extending substantially axially away from said combustion chamber and parallel to said quarter wave length reflection chamber, said secondary reflection chamber being of fixed length.

3. A stationary gas turbine combustor comprising, in combination;

a fuel nozzle for producing a flame which produces variable pressure waves which propogate from said flame;

a combustion chamber receiving said fuel nozzle at one end thereof and extending axially away from said fuel nozzle; and pressure wave interference means fixed within the interior of said combustor and disposed in the path of said variable pressure waves to modify the intensity of said pressure waves and the location of their nodes, said pressure wave interference means comprising an acoustical baffle disposed downstream of said flame, said acoustical baffle including a ring of truncated conical cross-section.

4. A stationary gas turbine combustor comprising, in combination:

a fuel nozzle for producing a flame which produces variable pressure waves which propagate from said flame;

a combustion chamber receiving said fuel nozzle at one end thereof and extending axially away from said fuel nozzle; and pressure wave interference means fixed within the interior of said combustor and disposed in the path of said variable pressure waves and the location of their nodes, said pressure wave interference means comprising a combustor cap which forms an angle with said one end of said combustion chamber so as to reflect pressure waves away from said fuel nozzle.

5. A stationary gas turbine combustor comprising, in combination:

a fuel nozzle for producing a flame which produces variable pressure waves which propagate from said flame said fuel nozzle shaped to reflect pressure waves away from said flame;

a combustion chamber receiving said fuel nozzle at one end thereof and extending axially away from said fuel nozzle; and pressure wave interference means fixed within the interior of said combustor and disposed in the path of said variable pressure waves to modify the intensity of said pressure waves and the location of their nodes.

* * * * *